US009903175B2

(12) United States Patent
Atkins et al.

(10) Patent No.: US 9,903,175 B2
(45) Date of Patent: Feb. 27, 2018

(54) PRESSURE CONTROL DEVICE

(76) Inventors: Nicholas Atkins, Bridge of Don (GB); Craig Spalding, Bridge of Don (GB); Tim Clarke, Bridge of Don (GB); David Hare, Bridge of Don (GB)

( * ) Notice: Subject to any disclaimer, the term of this patent is extended or adjusted under 35 U.S.C. 154(b) by 864 days.

(21) Appl. No.: 13/390,658

(22) PCT Filed: Jul. 29, 2010

(86) PCT No.: PCT/GB2010/001438

§ 371 (c)(1),
(2), (4) Date: May 3, 2013

(87) PCT Pub. No.: WO2011/020987

PCT Pub. Date: Feb. 24, 2011

(65) Prior Publication Data

US 2013/0263929 A1 Oct. 10, 2013

(30) Foreign Application Priority Data

Aug. 18, 2009 (GB) ..... 0914416.3

(51) Int. Cl.
*E21B 33/126* (2006.01)
*E21B 33/12* (2006.01)

(52) U.S. Cl.
CPC ..... *E21B 33/126* (2013.01); *E21B 33/1208* (2013.01); *Y10T 137/0379* (2015.04)

(58) Field of Classification Search
CPC ..... E21B 33/1208; E21B 33/1216; E21B 33/126; E21B 37/10; E21B 33/1285; E21B 33/128; E21B 23/04; E21B 23/06
See application file for complete search history.

(56) References Cited

U.S. PATENT DOCUMENTS 5,195,583 A * 3/1993 Toon ..... E21B 33/1243 166/179
7,997,337 B2 * 8/2011 Kunz ..... E21B 33/1277 166/122
8,678,099 B2 * 3/2014 McLeod ..... E21B 33/1293 166/136

(Continued)

FOREIGN PATENT DOCUMENTS

WO WO2005121498 12/2005
WO WO2006126925 11/2006
WO WO2009074785 6/2009

OTHER PUBLICATIONS

International Search Report for PCT/GB2010/001438, dated Nov. 3, 2011.

(Continued)

*Primary Examiner* — Robert E Fuller
(74) *Attorney, Agent, or Firm* — Frank J. Dykas; Dykas Law Offices, PLLC

(57) ABSTRACT

A pressure control device for isolating a section of a conduit comprises a support member, a flexible cup member mounted to the support member, a first swellable element, the first swellable element adapted, upon activation by an activation fluid, to urge a first portion of the cup member outwards into engagement with a conduit surface and at least one bypass arranged to permit the activation fluid to bypass the swellable element and build up behind a second portion of the cup member.

56 Claims, 9 Drawing Sheets

(56) References Cited

U.S. PATENT DOCUMENTS

| | | | | |
|---|---|---|---|---|
| 8,752,638 | B2 * | 6/2014 | Nutley | E21B 17/10 166/191 |
| 2007/0261863 | A1 * | 11/2007 | MacLeod | E21B 33/1216 166/387 |
| 2010/0038074 | A1 * | 2/2010 | Patel | E21B 33/1216 166/187 |
| 2010/0139929 | A1 * | 6/2010 | Rytlewski | E21B 33/1208 166/387 |
| 2010/0139930 | A1 * | 6/2010 | Patel | E21B 33/1277 166/387 |
| 2010/0276137 | A1 * | 11/2010 | Nutley | E21B 33/1216 166/185 |

OTHER PUBLICATIONS

International Preliminary Report on Patentability for PCT/GB2010/001438, dated Feb. 21, 2012.

* cited by examiner

PRESSURE CONTROL DEVICE

FIELD OF THE INVENTION

The present invention relates to a pressure control device for modulating pressure in a portion of a conduit.

BACKGROUND TO THE INVENTION

In the oil and gas exploration and extraction industries it is often desirable to be able to modulate downhole pressure when required. For example, it is desirable to isolate a section of well bore to create sections of differential pressure within the bore. A sealing device is used to create a seal within the bore, such that fluid pressure on one side of the seal increases relative to fluid pressure on the other side. Further, a temporary decrease in well pressure can be used to initiate flow from the reservoir in a process known as 'swabbing'. One means of doing this is to make use of a swab cup, which is a cup-shaped resilient member which is lowered on a mandrel into the well. As a pressure differential develops across the cup, the walls of the cup are pushed into contact with the well tubing or bore wall, thereby sealing a portion of the well. Thus, the pressure below the cup may decrease, while the pressure above may increase.

Similarly-constructed pressure cups are also used in a wide variety of other sealing and fluid lifting applications. For example, variations in pressure may also be used to actuate or to control other downhole tools and instruments which rely on fluid pressure for their operation. Conventional cups are constructed with an outer diameter slightly larger than that of the bore, such that a seal is present even when the cup is not inflated.

Conventional pressure cups suffer from a number of disadvantages. For example, as the cup is constructed with an outer diameter slightly larger than the diameter of the bore, the cup will rub against the bore as it is run into position. This can wear the cup and may affect the formation of a seal between the cup and the bore wall. Furthermore, if the bore has restrictions which narrow the width of the bore, it may not be possible to pass the restriction without damaging the pressure cup and an alternative sealing mechanism is required.

SUMMARY OF THE INVENTION

According to a first aspect of the present invention, there is provided a pressure control device for isolating a section of a conduit, the device comprising:

a support member;

a flexible cup member mounted to the support member;

a first swellable element, the first swellable element adapted, upon activation by an activation fluid, to urge a first portion of the cup member outwards into engagement with a surface of the conduit; and at least one bypass arranged to permit the activation fluid to bypass the swellable element and build up behind a second portion of the cup member.

In an embodiment of the present invention, a pressure control device is provided in which a flexible cup member is expanded outwardly into contact with a conduit surface, such as a wellbore surface or a downhole tubular surface under the action of a swellable element. Once engaged with the surface, the fluid in the conduit can not pass by the outer edge of the cup member and is channelled, via the bypasses, to build up behind a second portion of the cup member. Using a flexible cup member permits the cup member to form an initial seal with conduits which are irregular shapes such as open hole wellbore walls, and conduits which are, for example, key seated.

In the preferred embodiment, the build up of fluid behind the second cup member portion creates a pressure on the second cup member portion.

The second cup member portion is adapted to be moved under the action of the fluid pressure into engagement with the conduit surface. In the preferred embodiment, the pressure is allowed to build up sufficiently to move the second cup member portion into engagement with the surface thereby increasing the seal with between the cup member and the wellbore or tubular surface.

The pressure control device may define a throughbore.

The pressure control device may further comprise a mandrel, the mandrel located in the device throughbore.

The first cup member portion is adapted to form a lip seal with the surface.

The at least one bypass is defined by the first swellable element.

Alternatively, the at least one bypass is defined by the first swellable element and the mandrel.

Alternatively the at least one bypass is defined by the first swellable element and the cup member first portion.

In one embodiment the pressure control device further comprises a mandrel.

In this embodiment, the at least one bypass is defined by the mandrel.

In one embodiment, a void is defined behind the second cup member portion by the second cup member portion and the mandrel.

In one embodiment, a void is defined behind the second cup member portion by the second cup member portion, the first swellable element and the mandrel.

In an embodiment, the void comprises at least one inlet such that fluid can flow into the void from the at least one bypass.

The support member is sealed to the mandrel. A seal is provided to prevent the fluid leaving the void via the interface between the support member and the mandrel.

The seal is located downstream of the void.

The seal is an o-ring seal.

The seal may hold pressure from one direction only.

The apparatus may further comprise at least one stiffening device.

In one embodiment, the at least one stiffening device is adapted to stiffen the walls of a bypass. If each bypass is completely or partially defined by the swellable material and/or the cup member first portion, there is a tendency for the bypass to close, either partially or completely, as the swellable element swells and pressure increases in the cup member. Stiffening devices are provided to allow the bypass to continue to function as a bypass.

The at least one stiffening device may define a bypass either wholly or partially.

The at least one stiffening device may define a bypass in combination with a mandrel.

The stiffening device is a length of tubular.

The at least one stiffening device may extend the full height of the first swellable element.

The apparatus may comprise at least one anti-extrusion device. An anti-extrusion device is provided to prevent the first swellable element from swelling in an axial direction, thereby increasing the swell in a radial direction towards the cup member first portion.

In one embodiment there is a first anti-extrusion device preventing swelling in a first axial direction.

In an alternative or additional embodiment there is a second anti-extrusion device preventing swelling in a second axial direction, opposite the first axial direction.

In this embodiment the anti-extrusion devices are connected.

The anti-extrusion devices are connected by a connecting member.

The connecting member may wholly or partially define the at least one bypass.

The connecting member may define the at least one bypass in combination with a mandrel.

The anti-extrusion devices may define access means to permit the fluid to access the first swellable element.

The anti-extrusion devices may be attached to a mandrel. Attaching the anti-extrusion devices to a mandrel is preferred to attaching them directly to the swellable element, as attaching the anti-extrusion devices to the swellable element may inhibit swelling of the element.

The anti-extrusion devices may be rings.

The connecting member is a tubular.

The first swellable element may comprise ethylene propylene rubber, polyacrylic rubber, polyethers, acrylate polymers, tetra fluoro ethylene-propylene and/or hydrogenated nitrile rubber or any suitable compound.

The first swellable element may define the first cup member portion.

Alternatively the first cup member portion may comprise a different material.

In one embodiment the first cup member portion may comprise a swellable material.

The first cup member portion may comprise an elastomer.

The first cup member portion may comprise a rubber.

The pressure control device may further comprise a second swellable element, the second swellable element adapted, in use, to urge the second cup member portion outwards into engagement with the surface.

The second swellable element may swell at a slower rate than the first swellable element. Such an arrangement permits the first swellable element to swell the first cup member portion into engagement with the surface and form a lip seal before the second swellable element swells the second cup member portion into engagement with the surface.

In one embodiment the second cup member portion may comprise a swellable material.

The second cup member portion may comprise an elastomer.

The second cup member portion may comprise a rubber.

The activation fluid is water, oil or solvent or any suitable fluid.

The first swellable element is glued or bonded to the first cup member portion.

Alternatively, the first swellable element is separate from the first cup member portion.

The/each bypass is parallel to the direction of fluid flow. Such an arrangement minimises the length of flow path the fluid must travel to reach the second cup member portion.

The flexible cup member may comprise a back-up. A back-up is provided to prevent the cup member extruding down or along the conduit under the action of the applied pressure.

In one embodiment the back-up could be a garter spring.

In an alternative embodiment the back up could be a plurality of overlapping petals, a wire mesh, a continuous ductile ring, a portion of harder material adapted to resist the pressure or any suitable device or mechanism.

According to a second aspect of the present invention there is provided a method of isolating a section of a conduit, the method comprising the steps of:

positioning a pressure control device in a conduit;

activating a first swellable element under the action of an activation fluid such that the first swellable element urges a first portion of a control device flexible cup member outwards into engagement with a surface of the conduit to form a lip seal with said surface of the conduit;

providing a bypass such that the activation fluid can bypass the swellable element to build up behind a second portion of the cup member.

According to a third aspect of the present invention, there is provided a system for isolating a section of a conduit, the system comprising a plurality of pressure control devices, each device comprising:

a support member;

a flexible cup member mounted to the support member;

a first swellable element, the first swellable element adapted, upon activation by an activation fluid, to urge a first portion of the cup member outwards into engagement with a surface of the conduit; and at least one bypass arranged to permit the activation fluid to bypass the swellable element and build up behind a second portion of the cup member.

In one embodiment at least one of the cups faces in a first direction and, at least one of the cups faces in a second direction, the second direction being opposite the first direction. Such an arrangement permits pressure to be held from both ends or sides of the system.

Alternatively or additionally, there are a plurality of the pressure controlled devices facing the same direction. Such an arrangement allows improved pressure containment and provides redundancy in the system in the event that one of the cups fails or leaks.

It will be understood that the features of one aspect of the invention is equally applicable to other aspects and have not been repeated for brevity.

BRIEF DESCRIPTION OF THE DRAWINGS

Embodiments of the present invention will now be described with reference to the accompanying drawings in which.

DETAILED DESCRIPTION OF THE DRAWINGS

Figure 1:
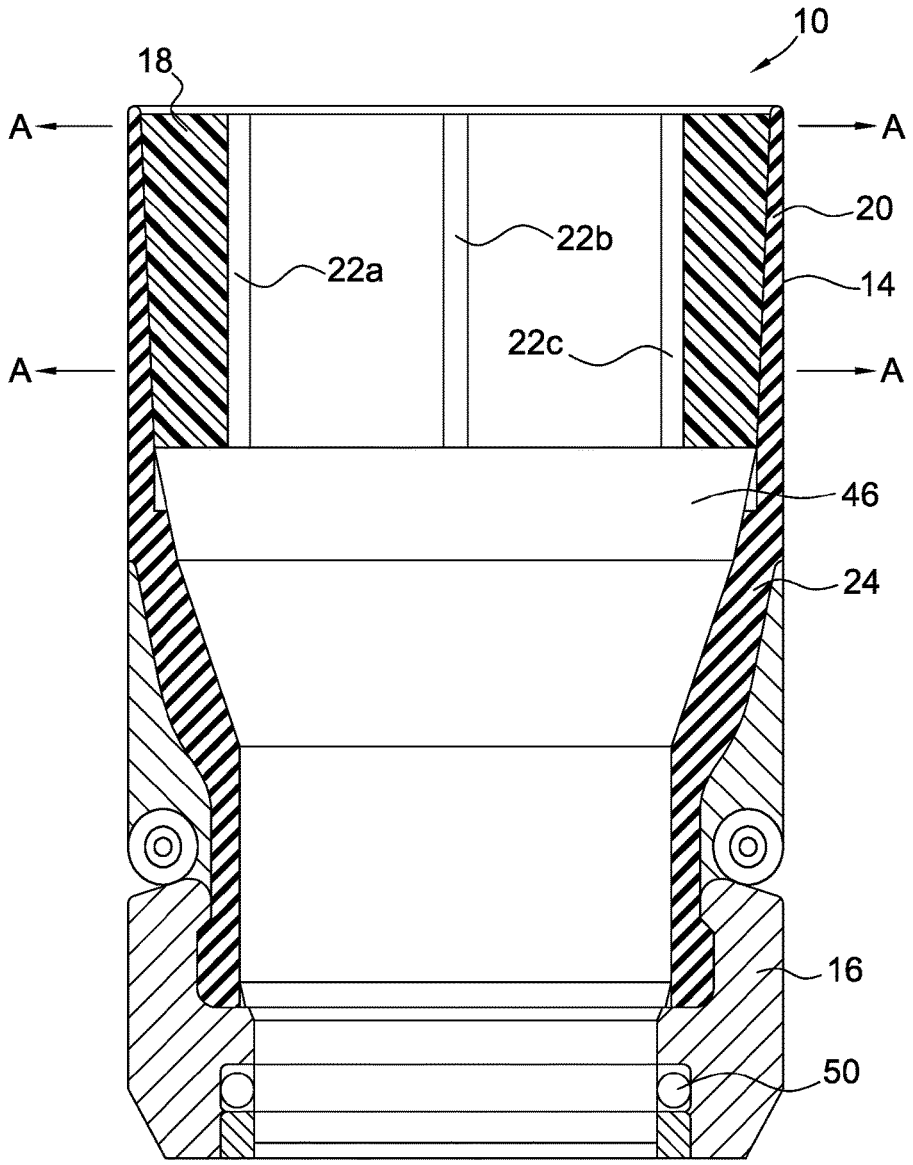
FIG. 1 is a section view of a pressure control device according to a first embodiment of the present invention.
Figure 2:
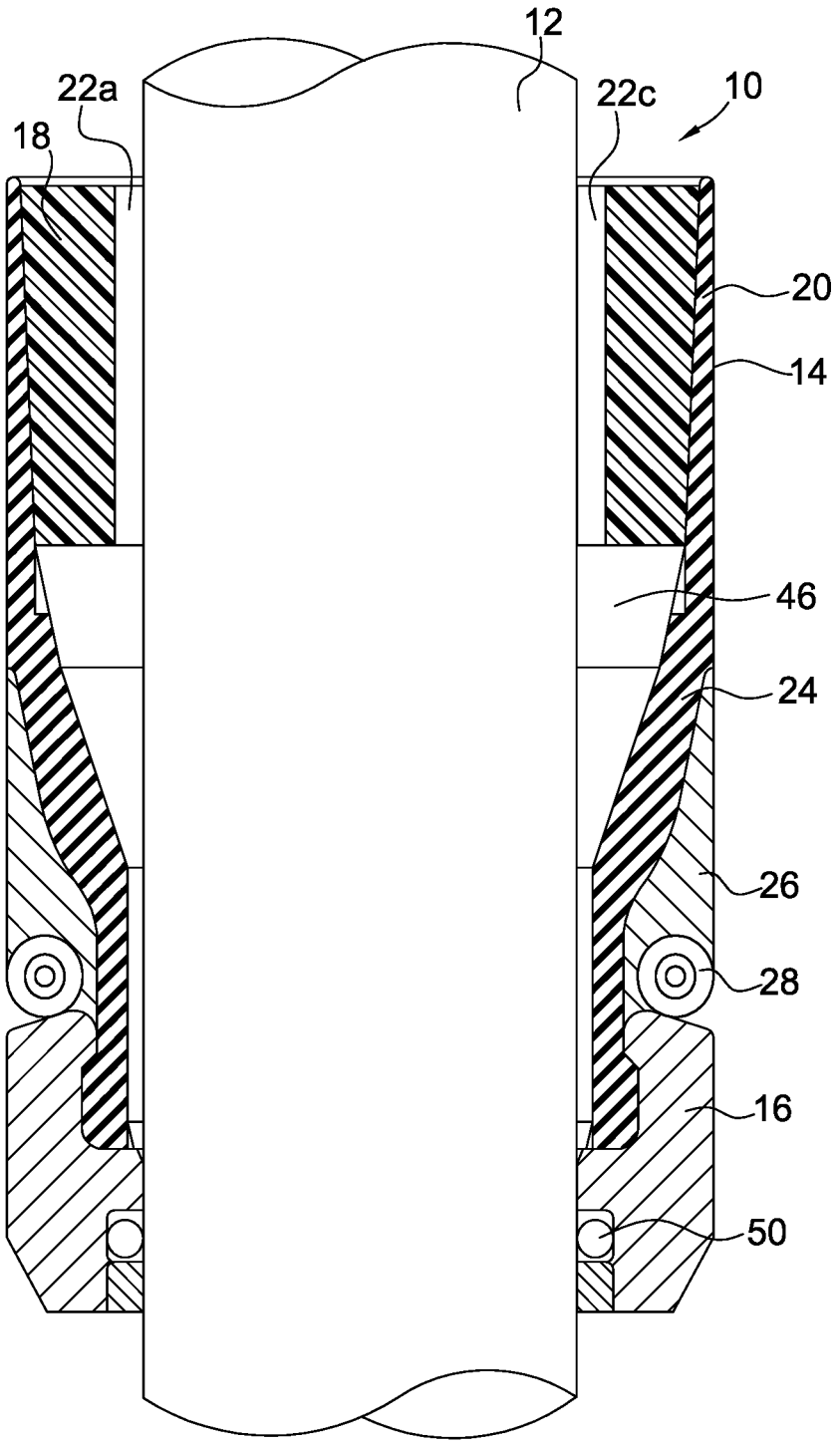
FIG. 2 is a section view of the pressure control device of FIG. 1 shown mounted on a mandrel.

Reference is firstly made to FIGS. 1 and 2. FIG. 1 is a section view of a pressure control device, generally indicated by reference numeral 10, according to a first embodiment of the present invention and FIG. 2 is a section view of the pressure control device 10 of FIG. 1 shown fitted to a mandrel 12. The pressure control device 10 is arranged to hold a pressure from above and comprises a soft rubber flexible cup member 14, mounted and bonded to a steel support member 16. The pressure control device 10 further comprises a first polyether swellable element 18, adapted, in use, to urge a first portion 20 of the cup member 14, upon activation, outwards (in the direction of arrows "A") into engagement with a surface (not shown).

The pressure control device 10 further comprises four bypasses 22, of which three 22*a-c* are shown on FIG. 1, arranged to permit a fluid to bypass the swellable element 18 and build up in a void 46 behind a second portion 24 of the cup member 14. An o-ring seal 50 seals the interface between the support member 16 and the mandrel 12, preventing fluid leaking out of the void 46 (best seen in FIG. 2).

An anti-extrusion back-up 26 of nitrile rubber is also provided on the cup member 14 to prevent the soft rubber flexible cup member 14 from extruding downwards when exposed to a pressure from above. The anti-extrusion back-up 26 is biased to the position shown in FIGS. 1 and 2 by an annular spring 28. This will be discussed in greater detail in due course.

Figure 3:
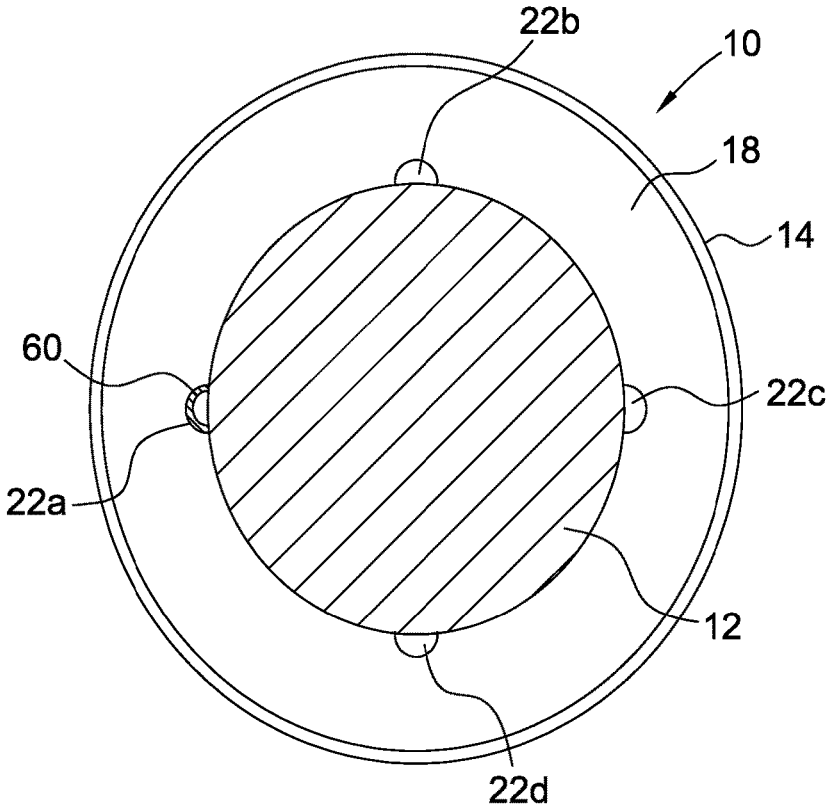
FIG. 3 is a top view of the pressure control device of FIG. 1.

Referring to FIG. 3, a plan view of the pressure control device 10 of FIG. 1, and to FIG. 2, each of the four bypasses 22 are defined by the mandrel 12 and the first swellable element 18. The portion of each bypass 22 defined by the swellable element 18 is lined by a stiffening device 60, shown only in connection with the first bypass 22*a* on FIG. 3. The stiffening devices 60 line the entire surface of the bypasses 22 and are in contact with the mandrel 12 preventing extrusion of the swellable element 18 into the bypasses 22. The semi-circular section of the stiffening devices 60 helps resist crushing by the swellable material.

Figure 5:
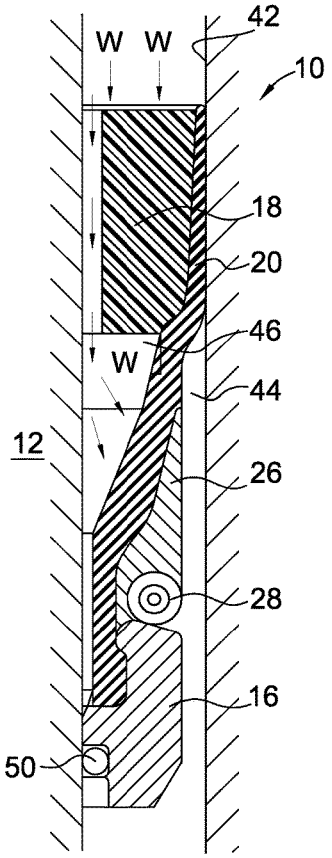
FIG. 5 is a section view of part of the pressure control device of FIG. 1 shown in a partially set configuration in a wellbore.
Figure 6:
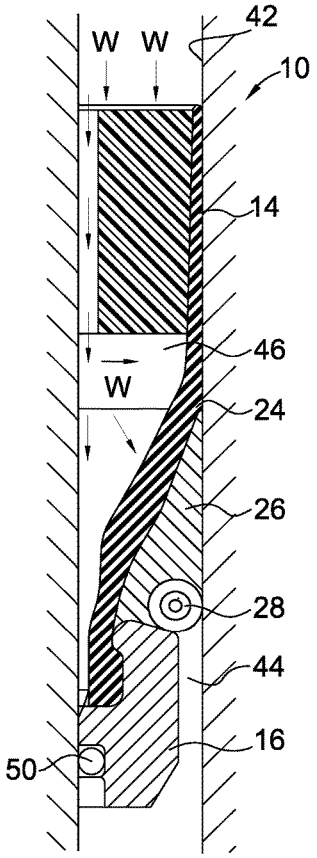
FIG. 6 is a section view of part of the pressure control device of FIG. 1 shown in a fully set configuration in a wellbore.

The operation of the pressure control device 10 will now be described with reference to FIGS. 4, 5 and 6, section views of part of the pressure control device 10 of FIG. 1 in a run-in configuration (FIG. 4), a partially set configuration (FIG. 5) and a fully set configuration (FIG. 6).

Figure 4:
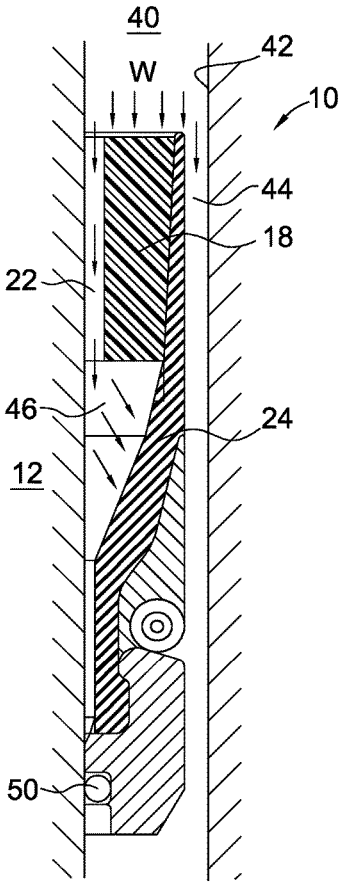
FIG. 4 is a section view of part of the pressure control device of FIG. 1 shown in a run in configuration in a wellbore.

In FIG. 4 the pressure control device 10 has been run into a wellbore 40 defining a wellbore surface 42. Water (W) is pumped down the wellbore 40 and comes into contact with the pressure control device 10. As can be seen, the water flows down the bypasses 22 into the void 46 between the cup member second portion 24 and the mandrel 12, and down an annulus 44 between the pressure controlled device 10 and the wellbore surface 42.

The swellable material in the first swellable element 18 is activated by contact with water and, referring to FIG. 5, the water causes the swellable element 18 to swell up, pushing the first cup member portion 20 into contact with, and form a lip seal with, the wellbore surface 42.

Once the cup member 14 has formed a lip seal with the wellbore surface 42, the fluid path down the annulus 44 is closed and pressure builds up in the void 46 beneath the swellable element 18. The pressure is held by the o-ring seal 50 which prevents leakage between the steel support member 16 and the mandrel 12.

Pressure begins to build up in the void 46, forcing the cup member second portion 24 into engagement with the wellbore surface 42. The anti-extrusion back-ups 26 and the annular spring 28 also rotate outwards against the bias of the annular spring 28 preventing extrusion of the flexible cup member 14 down the annulus 44, and maintaining the integrity of the cup member 14. Continued application of pressure on the pressure control device 10 from above will maintain the seal and energise the pressure control device 10 to hold the pressure.

Figure 7:
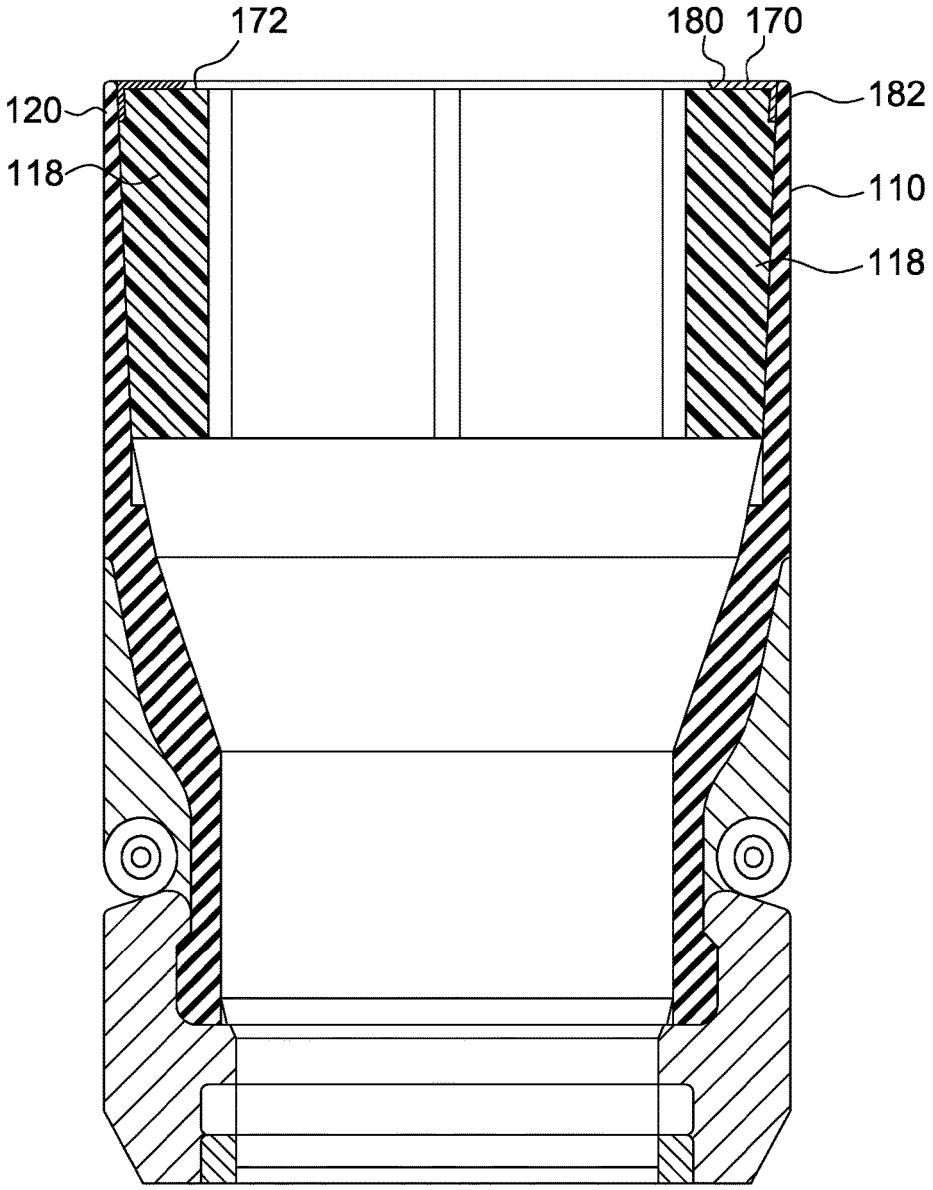
FIG. 7 is a section view of a pressure control device according to a second embodiment of the present invention.

Referring now to FIG. 7, a pressure control device 110 is shown in accordance with the second embodiment of the present invention. This pressure control device 110 is similar in most respects to the pressure control device 10 of the first embodiment, however the pressure control device 110 of the second embodiment includes an anti-extrusion ring 170 mounted to an upper surface of the swellable element 118 to prevent the swellable element 118 from swelling in an upward (axial) direction, therefore increasing the swell in the radial direction.

A first portion 180 of the anti extrusion device 170 is glued or otherwise bonded to an upper surface 172 of the swellable element 118 and a second portion 182 is glued or otherwise bonded and sandwiched between the cup member first portion 120 and the swellable material 118. The device upper portion 180 defines a plurality of holes (not visible) to permit the swelling fluid to contact the upper surface of the swellable element 118. It is believed that the upper surface of the swellable element, is where the most swelling occurs.

Figure 8:
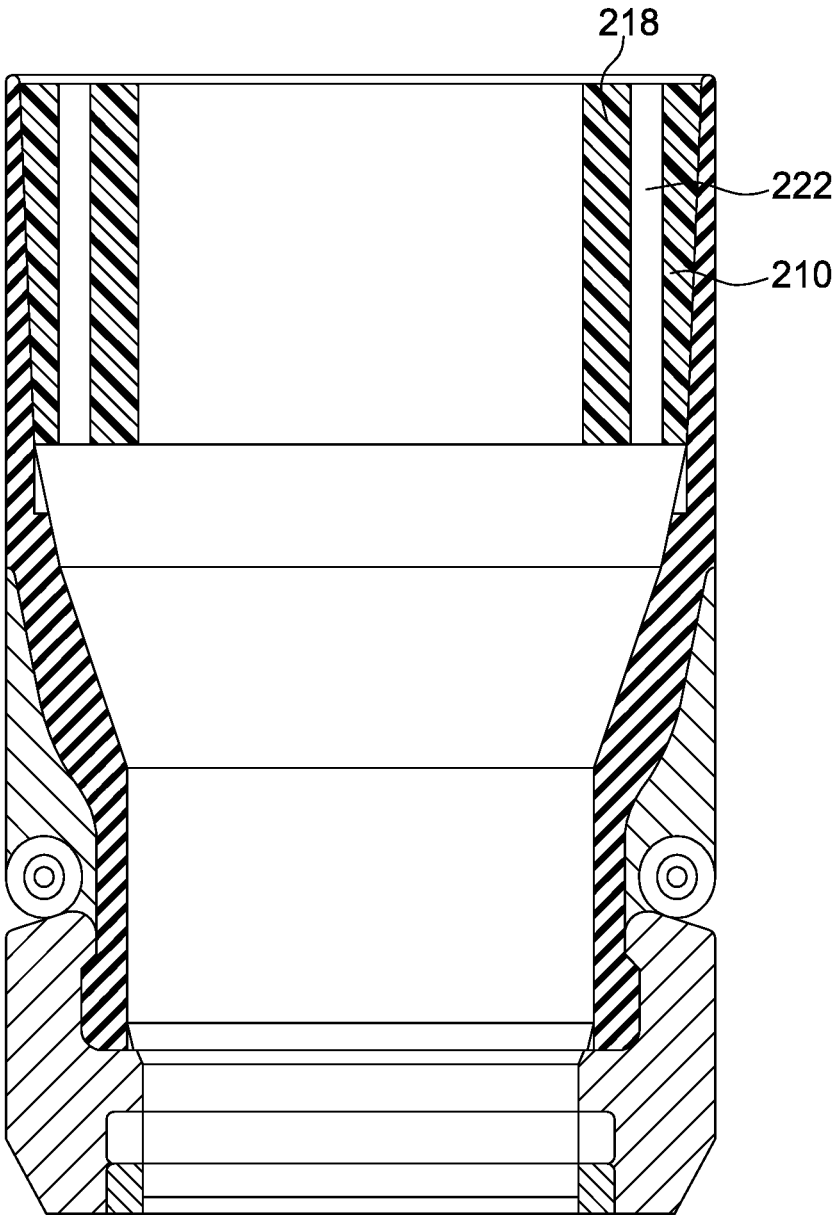
FIG. 8 is a section view of a pressure control device according to a third embodiment of the present invention.

FIG. 8 shows a pressure control device 210 according to a third embodiment of the present invention. In this embodiment, the bypasses 222 are wholly defined by the swellable element 218. In the embodiment shown in FIG. 8, the bypasses 222 are circular in cross section and moulded into the swellable element 218 during manufacture.

Figure 9:
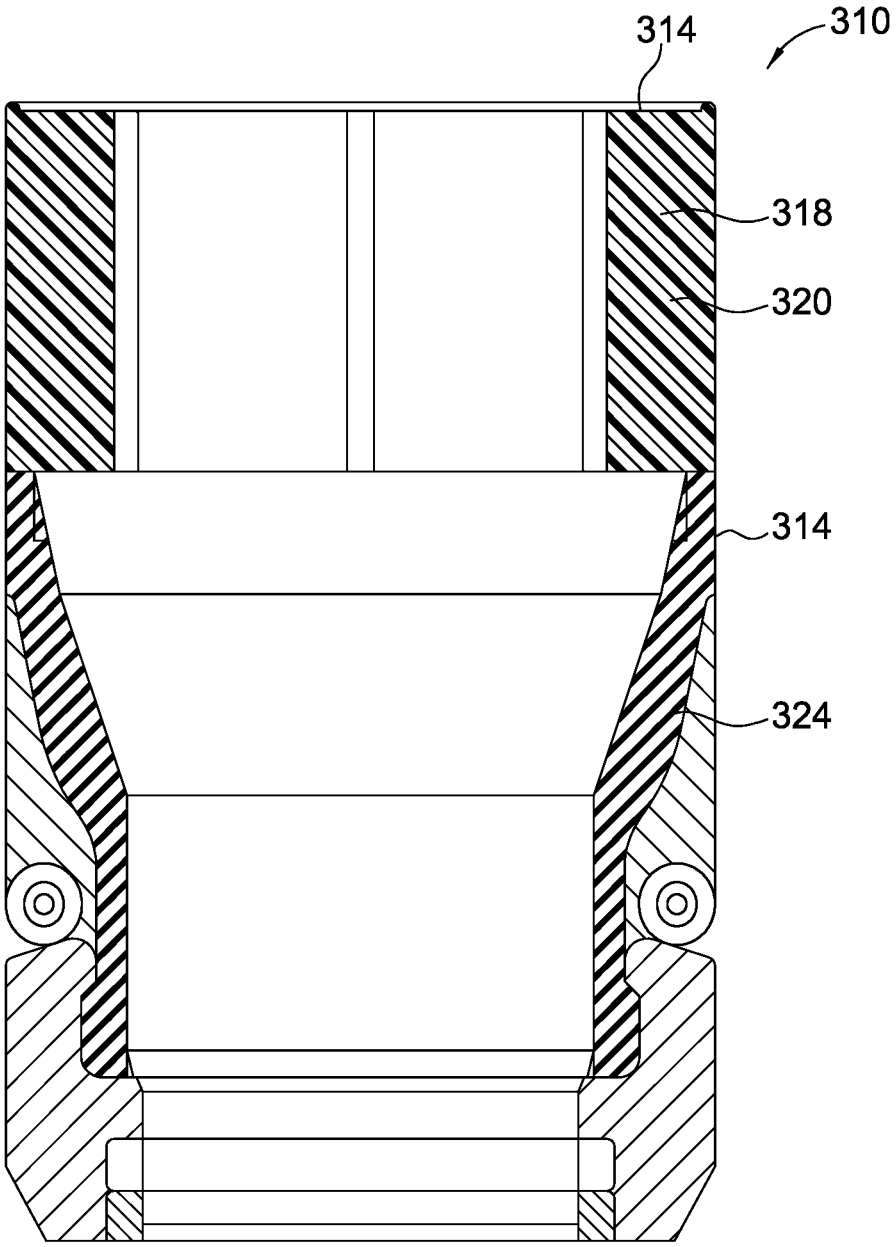
FIG. 9 is a section view of a pressure control device according to a fourth embodiment of the present invention.

FIG. 9 shows a fourth embodiment of the present invention. In this embodiment, the pressure control device 310 includes a swellable element 318 which also defines the cup member first portion 320. In essence the cup member first portion 320 is moulded from a swellable material. In addition the second portion 324 of the flexible cup member 314 is also moulded from a swellable material. In this embodiment, the second portion swellable material 324 swells at a slower rate than the first portion swellable material 318 and is believed the use of a swellable material in this way can improve the seal.

Figure 10:
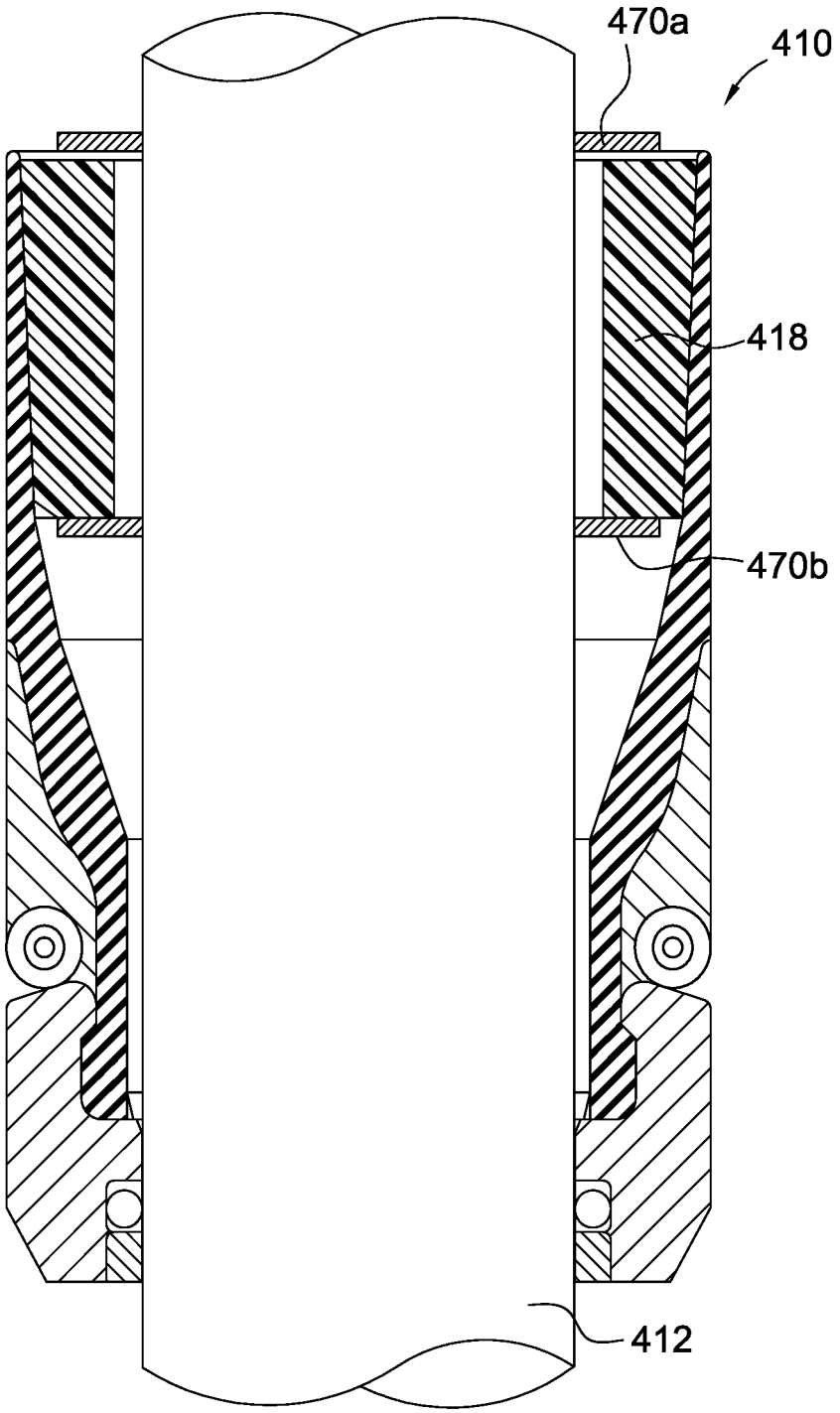
FIG. 10 is a section view of a pressure control device according to fifth embodiment of the present invention.

FIG. 10 shows a pressure control device 410 according to a fifth embodiment of the present invention. In this embodiment, there are upper and lower anti-extrusion devices in the from of rings 470*a*, 470*b*. These anti-extrusion rings 470 are attached to the mandrel 412 rather than the swellable element 418 so that swelling of the element 418 is not inhibited in the radial direction by bonding between the rings 470 and the swellable element 418.

Figure 11:
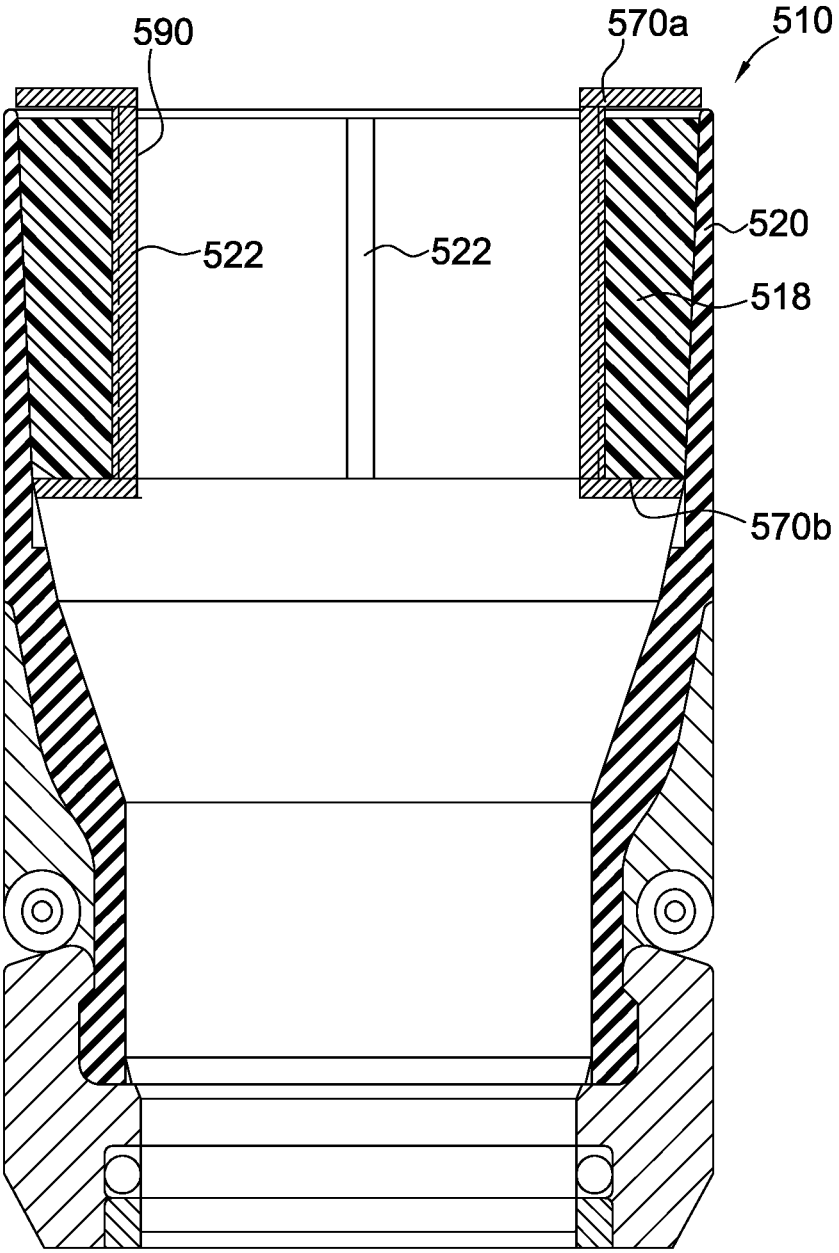
FIG. 11 is a section view of a pressure control device according to a sixth embodiment of the present invention.

FIG. 11 shows a pressure control device 510 according to a sixth embodiment of the present invention. In this embodiment, rather than being attached to a mandrel, the upper and lower anti-extrusion rings 570*a*, 570*b* are attached to a tubular connecting member 590. The connecting member 590 permits positioning of the anti-extrusion rings 570 above and below the swellable element 518 without the need to bond the anti-extrusion rings 570 to the swellable element 518. The combination of the anti-extrusion rings 570 and the connecting member 590 prevents the swellable element 518 swelling in any direction other than radially outwardly, towards the cup member first portion 520, thereby maximising the effect of the swellable element 518.

The connecting member 590 partially defines the bypasses 522, the bypasses 522 being wholly defined by the connecting member 590 and a mandrel (not shown).

In the embodiments of FIGS. 10 and 11, the anti-extrusion devices 470, 570 and where applicable the connecting member 590 define apertures to allow the fluid to access the swellable element 418,518 to swell the element 418,518.

Various modifications and improvements can be made to the above described embodiment without departing from the scope of the present invention. For example, although the bypasses are shown as being defined by the swellable element alone or the swellable element in conjunction with a mandrel, they could be defined by the swellable element in conjunction with the flexible cup member.

Additionally it will be understood that although the pressure control device is shown holding pressure from above, it will be understood that the control device could be inverted to hold pressure from below, or the device could be one of a plurality of devices, arranged in series, to hold pressure from one direction or facing in opposite directions to hold pressure from above and below.

Furthermore it will also be understood that although a hard rubber back-up is used in the embodiments described, an overlapping petal arrangement of back-up could also be used.

The invention claimed is:

1. A pressure control device for isolating a section of a conduit, the device comprising:

a support member;

a flexible cup member mounted to the support member;

a first swellable element, the first swellable element adapted, upon activation by an activation fluid, to urge a first portion of the cup member outwards into engagement with a surface of the conduit;

at least one bypass arranged to permit a portion of the activation fluid to bypass the swellable element to permit build up of the portion of the activation fluid in a void behind a second portion of the cup member to move the second portion of the cup member into engagement with the surface of the conduit; and at least on stiffening device adapted to stiffen the walls of the at least one bypass and prevent activation of the swellable element by the portion of the activation fluid while the portion of the activation fluid is in the at least one bypass.

2. The device of claim 1, wherein the build up of fluid behind the second cup member portion creates a pressure on the second cup member portion.

3. The device of claim 1, wherein the pressure control device defines a throughbore.

4. The device of claim 3, wherein the pressure control device further comprises a mandrel, the mandrel located in the device throughbore.

5. The device of claim 4, wherein the at least one bypass is defined by the first swellable element and the mandrel.

6. The device of claim 1, wherein the first cup member portion is adapted to form a lip seal with the surface.

7. The device of claim 1, wherein the at least one bypass is defined by the first swellable element.

8. The device of claim 1, wherein the at least one bypass is defined by the first swellable element and the cup member first portion.

9. The device of claim 1, wherein the pressure control device further comprises a mandrel.

10. The device of claim 9, wherein the at least one bypass is defined by the mandrel.

11. The device of claim 9, wherein the void is defined behind the second cup member portion by the second cup member portion and the mandrel.

12. The device of claim 11, wherein the void is defined behind the second cup member portion by the second cup member portion, the first swellable element and the mandrel.

13. The device of claim 11, wherein the void comprises at least one inlet such that the portion of the activation fluid can flow into the void from the at least one bypass.

14. The device of claim 11, wherein a seal is located downstream of the void.

15. The device of claim 14, wherein the seal is an o-ring seal.

16. The device of claim 14, wherein the seal holds pressure from one direction only.

17. The device of claim 9, wherein the support member is sealed to the mandrel.

18. The device of claim 1, wherein the at least one stiffening device defines a bypass either wholly or partially.

19. The device of claim 1, wherein the at least one stiffening device defines a bypass in combination with a mandrel.

20. The device of claim 1, wherein the stiffening device is a length of tubular.

21. The device of claim 1, wherein the at least one stiffening device extends the full height of the first swellable element.

22. The device of claim 1, wherein the apparatus comprises at least one anti-extrusion device.

23. The device of claim 22, wherein the at least one anti-extrusion device defines access means to permit the fluid to access the first swellable element.

24. The device of claim 22, wherein the at least one anti-extrusion device is attached to a mandrel.

25. The device of claim 22, wherein the at least one anti-extrusion device is a ring.

26. The device of claim 22, wherein the connecting member is a tubular.

27. The device of claim 1, wherein the at least one anti-extrusion device comprises a first anti-extrusion device preventing swelling in a first axial direction.

28. The device of claim 27, wherein the at least one anti-extrusion device comprises a second anti-extrusion device preventing swelling in a second axial direction, opposite the first axial direction.

29. The device of claim 28, wherein the first anti-extrusion device and the second anti-extrusion device are connected.

30. The device of claim 29, wherein the first anti-extrusion device and the second anti-extrusion device are connected by a connecting member.

31. The device of claim 30, wherein the connecting member wholly or partially defines the at least one bypass.

32. The device of claim 31, wherein the connecting member defines the at least one bypass in combination with a mandrel.

33. The device of claim 1, wherein the first swellable element comprises at least one of: ethylene propylene rubber; polyacrylic rubber; polyethers; acrylate polymers; tetra fluoro ethylene-propylene; and hydrogenated nitrile rubber.

34. The device of claim 1, wherein first swellable element defines the first cup member portion.

35. The device of claim 1, wherein the first cup member portion comprises a different material than a material of the second cup member portion.

36. The device of claim 1, wherein the first cup member portion comprises a swellable material.

37. The device of claim 1, wherein the first cup member portion comprises an elastomer.

38. The device of claim 1, wherein the first cup member portion comprises a rubber.

39. The device of claim 1, wherein the pressure control device further comprises a second swellable element, the second swellable element adapted, in use, to urge the second cup member portion outwards into engagement with the surface.

40. The device of claim 39, wherein the second swellable element swells at a slower rate than the first swellable element.

41. The device of claim 1, wherein the second cup member portion comprises a swellable material.

42. The device of claim 1, wherein the second cup member portion comprises an elastomer.

43. The device of claim 1, wherein the second cup member portion comprises a rubber.

44. The device of claim 1, wherein the activation fluid is one of water, oil and solvent.

45. The device of claim 1, wherein the first swellable element is glued or bonded to the first cup member portion.

46. The device of claim 1, wherein the first swellable element is separate from the first cup member portion.

47. The device of claim 1, wherein the at least one bypass is parallel to the direction of fluid flow.

48. The device of claim 1, wherein the flexible cup member comprises a back-up.

49. The device of claim 48, wherein the back-up is a garter spring.

50. The device of claim 48, wherein the back up is one of: a plurality of overlapping petals; a wire mesh; and a continuous ductile ring.

51. The device of claim 1, wherein the support member is configured to be sealed to a mandrel.

52. The device of claim 1, wherein the first portion of the cup member defines a distal end of the cup member.

53. A method of isolating a section of a conduit, the method comprising the steps of:

positioning a pressure control device in a conduit;

activating a first swellable element under the action of an activation fluid such that the first swellable element urges a first portion of a control device flexible cup member outwards into engagement with a surface of the conduit to form a lip seal with said surface of the conduit;

providing at least one bypass such that the activation fluid can bypass the swellable element to build up in a void behind a second portion of the cup member to move the second portion of the cup member into engagement with the surface of the conduit, wherein the walls of the at least one bypass are stiffened by at least one stiffening device to prevent activation of the swellable element by the portion of the activation fluid while the portion of the activation fluid is in the at least one bypass.

54. A system for isolating a section of a conduit, the system comprising a plurality of pressure control devices, each device comprising:

a support member;

a flexible cup member mounted to the support member;

a first swellable element, the first swellable element adapted, upon activation by an activation fluid, to urge a first portion of the cup member outwards into engagement with a surface of the conduit;

at least one bypass arranged to permit a portion of activation fluid to bypass the swellable element to permit build up in a void behind a second portion of the cup member to move the second portion of the cup member into engagement with the surface of the conduit;

at least one stiffening device being adapted to stiffen the walls of the at least one bypass and prevent activation of the swellable element by the portion of the activation fluid while the activation fluid is in the at least one bypass.

55. The system of claim 54, wherein at least one of the cups faces in a first direction and, at least one of the cups faces in a second direction, the second direction being opposite the first direction.

56. The system of claim 54, wherein there are a plurality of the pressure control devices facing the same direction.

* * * * *